US005333668A

United States Patent [19]

Jorstad et al.

[11] Patent Number: 5,333,668

[45] Date of Patent: Aug. 2, 1994

[54] PROCESS FOR CREATION OF METALLURGICALLY BONDED INSERTS CAST-IN-PLACE IN A CAST ALUMINUM ARTICLE

[75] Inventors: John L. Jorstad; Richard A. Morley, both of Richmond; William H. Overbagh, Chesterfield; George W. Steele, Glenn Allen, all of Va.

[73] Assignee: Reynolds Metals Company, Richmond, Va.

[21] Appl. No.: 803,846

[22] Filed: Dec. 9, 1991

[51] Int. Cl.[5] ..... B22D 19/08

[52] U.S. Cl. ..... 164/100; 164/102; 164/103; 164/108

[58] Field of Search ..... 164/75, 100, 101, 102, 164/103

[56] References Cited

U.S. PATENT DOCUMENTS

| | | | |
|---|---|---|---|
| 2,265,243 | 12/1941 | McCullough et al. | 164/75 |
| 2,328,788 | 9/1943 | Deputy | 164/75 |
| 2,544,671 | 3/1951 | Grange et al. | 22/204 |
| 2,634,469 | 4/1953 | Pershing et al. | 22/204 |
| 2,849,790 | 9/1958 | Zwicker | 164/75 |
| 3,276,082 | 10/1966 | Thomas | 164/75 |
| 3,480,465 | 11/1969 | Imabayashi et al. | 164/75 |
| 3,945,423 | 3/1976 | Hannig | 164/75 |
| 4,008,052 | 2/1977 | Vishnevsky et al. | 29/194 |
| 4,687,043 | 8/1987 | Weiss et al. | 164/97 |
| 5,005,469 | 4/1991 | Ohta | 92/169.4 |
| 5,012,776 | 5/1991 | Yamagata | 123/193 C |
| 5,080,056 | 1/1992 | Kramer et al. | 123/193 CP |

FOREIGN PATENT DOCUMENTS

| | | | |
|---|---|---|---|
| 52-17330 | 2/1977 | Japan | 164/100 |
| 62-89564 | 4/1987 | Japan | 164/100 |

OTHER PUBLICATIONS

Metals Handbook, vol. 2, 8th Edition, pp. 498–501, 1964.

*Primary Examiner*—Richard K. Seidel
*Assistant Examiner*—Erik R. Puknys

[57] ABSTRACT

Processes for coating a ferrous or aluminum article, such as an engine cylinder liner insert, to provide a metallurgical bond with aluminum alloy material cast around the article. The article surface to be bonded is treated to remove impurities, oxides, and foreign materials, and the article is preheated. A molten metallic bonding material, such as zinc or a zinc alloy, is provided and the treated and preheated article is immersed in the bonding material to provide a metallurgically bonded coating on the surface of the article being treated. The coated article, either shortly after coating or, alternatively, after having been cooled to ambient temperature and stored, can then be placed in a mold and molten aluminum alloy poured around it to metallurgically bond the aluminum to the coating on the article. The resulting structure provides a metallurgical bond that has improved heat transfer characteristics and improved structural integrity. The invention also provides improved assemblies having metallurgically bonded components, such as an engine block having metallurgically bonded cylinder liners.

23 Claims, 5 Drawing Sheets

PROCESS FOR CREATION OF METALLURGICALLY BONDED INSERTS CAST-IN-PLACE IN A CAST ALUMINUM ARTICLE

BACKGROUND OF THE INVENTION

Field of the Invention

The present invention relates to processes for treating the surfaces of metallic inserts for incorporation into cast aluminum articles formed by casting molten aluminum (alloys) around said inserts. More particularly, the present invention relates to processes for surface treatment of engine cylinder liner inserts to permit the formation of a substantially continuous metallurgical bond between the external cylindrical surfaces of the liner inserts and the surrounding cast aluminum engine block. Proper application of this technology can provide a strong structural connection between the individual liner inserts and the cast block, and also can provide a liner-to-block interface that permits improved heat transfer between the liner inserts and the coolant for removal of combustion and friction heat when the engine is in operation.

Description of the Related Art

Cast internal combustion engine blocks, such as those used to produce engines adapted to be installed in vehicles such as automobiles, have for a long time been formed from cast iron for the purposes of structural rigidity of the engine, and resistance to wear caused by the rapid sliding movement within a cylinder bore of a cylindrical piston having several piston rings with hardened wear surfaces. The use of cast iron as the block material, however, results in a very heavy engine which, because of its weight, increases fuel consumption. This runs counter to the modern trend of providing lighter weight automobiles for increased fuel economy.

One way to increase the fuel economy of an automobile is to reduce the weight of the engine by making the engine block from an aluminum alloy, because aluminum has considerably lower density than cast iron. Although Aluminum Association registered alloys 390, A390, and B390 (hereinafter "390") have the required strength, are suitable for casting and have the required resistance to wear to ensure long, trouble-free engine life, at times it might be desirable to provide an aluminum engine block having cylinder liner inserts.

However, when cast iron or bare 390 alloy cylinder liner inserts have molten aluminum poured around them to forman aluminum alloy engine block, no metallurgical bond exists between the aluminum alloy casting and the cylinder liner inserts. Consequently, the connection between the cylinder liner inserts and the surrounding aluminum alloy block is merely a mechanical connection (defined by a distinct interfacial discontinuity) which limits the rate of heat transfer from the liner, through the adjacent engine block, and to the engine coolant (air or liquid) resulting in less efficient cooling of the engine.

One approach to the manufacture of a cast aluminum alloy engine block having plural cylinders, each including a cast iron liner insert, is disclosed in U.S. Pat. No. 5,005,469, which issued on Apr. 9, 1991, to Masanori Ohta. In that patent the cast iron liners are united in spaced, side-by-side relationship by first casting an aluminum alloy around the several laterally spaced liners to form a cylinder liner unit. This cylinder liner unit is subsequently placed in an engine block mold and a molten aluminum alloy is poured around it to complete the engine block structure. However, because the aluminum alloy that is cast around the liners must be of sufficient thickness to provide structural rigidity to the liner unit, the resulting engine block is heavier than necessary and also results in less efficient heat transfer between the cylinder liner and the cooling medium due to the lack of a metallurgical bond between the iron liners and the liner unit casting or between the liner unit casting and the aluminum block casting.

Another patent that discloses the casting of molten aluminum alloy about a cast iron cylinder liner insert is U.S. Pat. No. 5,012,776, which issued on May 7, 1991, to Hiroshi Yamagata. That patent merely discloses the placing of a cast iron cylinder liner insert into a mold, along with the associated core members, and then pouring molten aluminum alloy into the mold and about the liner insert.

A process for casting a layer of aluminum coating onto a ferrous body is disclosed in U.S. Pat. No. 2,544,671, which issued on Mar. 13, 1951, to Howard L. Grange and Dean K. Hanink and is known in the trade as the "ALFIN" process. The ferrous body is cleaned in a heated salt bath capable of absorbing iron oxide. After cleaning in the salt bath, the ferrous body is immersed for a short period of time in molten aluminum or aluminum alloy which wets and coats the body with a layer of aluminum or aluminum alloy. The thus coated ferrous body is then withdrawn from the molten aluminum and, before the aluminum coating solidifies, the coated body is immediately placed into a mold and molten aluminum is poured into the mold against the coated ferrous body. While the ferrous body and the aluminum poured against it, in fact, become metallurgically bonded together, the process succeeds in such a bond only if the coated ferrous body is surrounded by molten aluminum while the coating is still molten. The coated ferrous body cannot be cooled to ambient temperature and stored for later use.

Although the notion of making internal combustion engine blocks wherein the block material is a cast aluminum body and the cylinders are defined by hollow, tubular, ferrous-based liner inserts, surrounded by a significant thickness of cast aluminum, is known; it has been found that merely casting the aluminum around a liner insert results in only discontinuous surface-to-surface contact of the aluminum with the liner insert, without a metallurgical bond between the two materials. As a result, the heat transfer from the interior of the liner insert to the external coolant, whether it be a liquid or gaseous coolant, is less effective than would be the case if the two dissimilar materials were metallurgically bonded to each other to provide a continuous, uninterrupted heat flow path. The ability to transfer heat from the liners to the engine coolant increases in significance as the engine power output is increased, which in turn increases the operating temperatures within the combustion chambers; and also as the thermal efficiency of such engines is increased by virtue of operation at higher temperatures.

A second result of having unbonded cylinder liner inserts is that the engine block design must be heavier than necessary to achieve the required structural stiffness because the liner and surrounding casting structurally perform independent of each other. On the other hand, when the cylinder liner inserts are metallurgically bonded to the cast aluminum engine block, the liner and block structurally act as a unit, enabling the lightest weight design.

Another result of having unbonded cylinder liner inserts is the potential for movement between the unbonded liners and the block during service, which can create sealing problems. When the cylinder liners are metallurgically bonded, such movement is prevented.

In addition to the desirability of providing a metallurgical bond between the cylinder liner inserts and the poured aluminum block for improved engine operating efficiency, it is also desired that any surface treatment of the cylinder liner inserts be such that treated inserts can either be used shortly after treatment, or, alternatively, that they can be cooled to ambient temperature and can be stored for later use.

It is therefore an object of the present invention to provide a cast aluminum engine block containing cylinder liner inserts made from either a ferrous material, such as cast iron, or an aluminum material, such as 390 alloy, and in which the cylinder liner inserts are metallurgically bonded to the block material to provide a continuous, uninterrupted heat flow path from the inner surface of the cylinder liner inserts, through the liner inserts, and through the block material to the engine cooling medium (liquid or gas). Achievement of metallurgically bonded cylinder liner inserts will also allow improved structural integrity and thus the lightest engine block weight.

It is a further object of the present invention to provide a surface coated cylinder liner insert that can be stored for subsequent use in a casting process wherein aluminum or an aluminum alloy is cast about the liner insert and a metallurgical bond is achieved.

SUMMARY OF THE INVENTION

Briefly stated, in accordance with one aspect of the present invention, a process is provided for coating a surface of an insert made from a ferrous material. The surface of the ferrous insert is coated with a thin layer of metallic bonding material to enable the coated insert to be metallurgically united with molten aluminum alloy in a casting process in which molten aluminum (alloy) is poured about the coated surface of the insert.

In accordance with another aspect of the present invention, a process is provided for pretreating and coating the exterior cylindrical surface of a hollow, cylindrical, ferrous cylinder liner insert with a metallic bonding material to enable the coated ferrous liner insert to be metallurgically bonded with aluminum (alloy) in a casting process in which molten aluminum (alloy) is poured around the pretreated, preheated and coated exterior surface of the liner insert. The process includes pretreating the outer cylindrical surface of the ferrous liner insert to remove impurities, oxides, and foreign materials, to make the outer surface more receptive to the coating. The pretreated ferrous liner insert is then preheated to about 250° F.

A molten metallic bonding material is provided, the bonding material having a melting temperature lower than that of the ferrous insert material and lower than the melting temperature of the aluminum casting alloy, but higher than the intended service temperature of the resulting engine block. The molten metallic bonding material is capable of forming intermetallic compounds with the iron in the ferrous liner insert material and thus is capable of being metallurgically bonded to the outer surface of the ferrous liner insert.

The ferrous liner insert is immersed in the molten metallic bonding material for a predetermined time sufficient to cause the molten metallic bonding material to wet and to alloy with the pretreated and preheated outer surface of the cylinder liner insert and to completely coat and to metallurgically bond to the outer cylindrical surface of the liner insert. Thereafter the thus externally coated ferrous liner insert is cooled to cause the thin coating of the metallic bonding material to solidify.

In accordance with still another aspect of the present invention, a process is provided for coating a surface of an aluminum article, such as the exterior cylindrical surface of a hollow, cylindrical cylinder liner insert made from an aluminum alloy such as 390 alloy. The surface of the article or insert is coated with a thin layer of metallic bonding material to enable the coated insert to be metallurgically united with molten aluminum alloy in a casting process in which molten aluminum (alloy) is poured about the coated surface of the insert.

A molten metallic bonding material is provided, the bonding material having a melting temperature lower than that of the aluminum insert material and lower than the melting temperature of the aluminum casting alloy, but higher than the intended service temperature of the resulting engine block. The molten metallic bonding material is capable of alloying with the liner insert material and thus is capable of being metallurgically bonded to the outer surface of the liner insert. The molten bonding material, in one embodiment, is contained in an ultrasonic coating pot.

The aluminum liner insert is preheated and immersed in the molten metallic bonding material while ultrasonic energy is applied for a predetermined time sufficient to cause the molten metallic bonding material to wet and to alloy with the preheated outer surface of the cylinder liner insert to completely coat and to metallurgically bond to the outer cylindrical surface of the liner insert. Thereafter the externally coated aluminum liner insert is cooled to cause the thin coating of the metallic bonding material to solidify.

In accordance with still another aspect of the present invention, ferrous or aluminum cylinder liner inserts (treated as hereinabove described) are preheated and placed within an engine block mold. Molten aluminum is then poured into the mold to surround the outer surface of the liner inserts. The molten aluminum subsequently alloys with the metallic bonding material carried on the outer surface of the liner inserts and thus metallurgically bonds therewith. The bond herein described provides a strong connection between the cast aluminum engine block and the cylinder liner inserts. The bond provides a continuous, uninterrupted heat transfer path between the interior surface of the liner and a liquid or gaseous coolant that is circulated around the aluminum block material and it also provides increased structural integrity.

DESCRIPTION OF THE PREFERRED EMBODIMENTS

Figure 1:
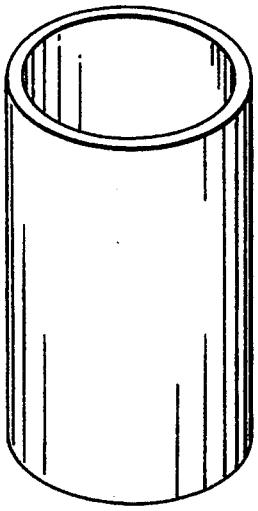
FIG. 1 is a perspective view of a hollow, cylindrical liner insert for defining the interior surface of an engine cylinder within which a piston is reciprocatingly movable.
Figure 2:
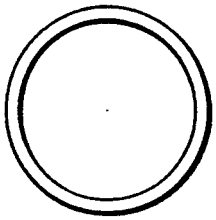
FIG. 2 is a cross-sectional view of FIG. 1.
Figure 9:
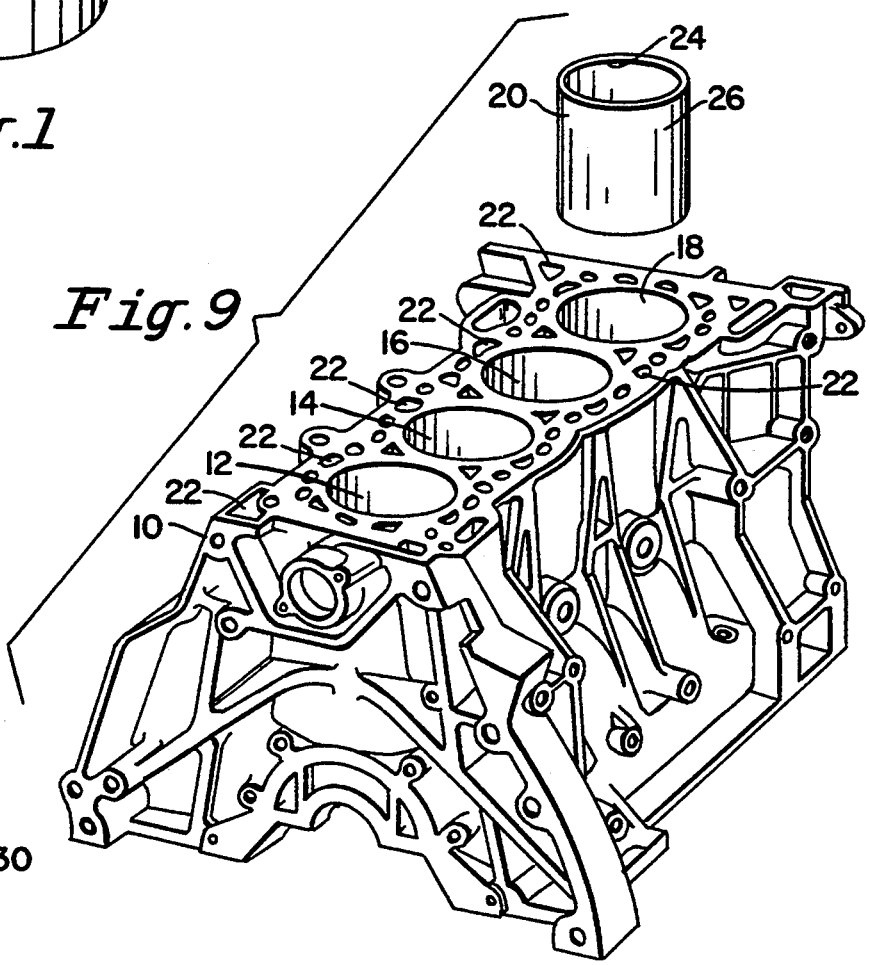
FIG. 9 is a schematic perspective view showing an aluminum engine block for a four cylinder automotive engine.

Referring now to the drawings, and particularly to FIGS. 1, 2, 9, and 9*a* thereof, there is shown in FIG. 9 an engine block 10 including four individual cylinder bores 12, 14, 16, and 18, each having their respective axes parallel with each other and spaced from each other along the longitudinal axis of the block. A tubular cylindrical cylinder liner or sleeve 20 is shown in FIGS. 1 and 2, and is further shown in FIG. 9*a* positioned in cylinder bore 12 to provide a desired wear surface for a reciprocating piston 34 slidably carried within the liner 20. As will be appreciated, each of cylinder bores 14, 16, and 18 is also intended to have positioned in it a liner 20, but only one such liner is shown for clarity of illustration. Further, those skilled in the art will understand that a cylinder head (not shown) is secured to the top of block 10 and an oil pan (not shown) is attached to the bottom of the block, and it will also be appreciated that other arrangements of the bores within the block are possible.

Figure 9A:
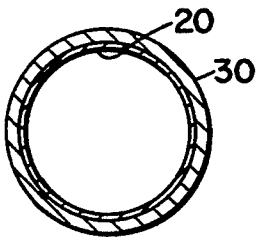
FIG. 9*a* is a cross-sectional view taken along the line 2—2 of FIG. 9 showing a transverse cross-section through a cylinder having a liner insert cast and metallurgically bonded in place.

Engine block 10 is preferably of cast aluminum alloy construction and made from any of several alloys, for example, alloys 319, 333, 356, 380, or 390, each of which has desirable strength and weight in a composition that is readily cast and machined and is suitable to be used for casting internal combustion engine blocks. As shown in FIGS. 9 and 9*a*, engine block 10 includes a plurality of individual passageways 22 extending generally along the peripheries of bores 12, 14, 16, and 18 to provide channels through which a coolant can be circulated to maintain the temperature of the block at or below a predetermined temperature during its service as an engine. Although illustrated and described in the context of a liquid-cooled engine having internal coolant passageways, it will be apparent to those skilled in the art that the present invention can also be applied to air-cooled engines, possibly including external cooling fins.

Cylinder liner 20 can be made from either a ferrous material, such as cast iron, or from a suitable aluminum alloy, such as alloys 390, A390, or B390, or other similar hypereutectic Al-Si alloys. Each liner 20 includes a cylindrical inner surface 24 and a cylindrical outer surface 26, and is adapted to fit within a cylinder bore as will be hereafter explained in greater detail.

In the manufacture of engine blocks 10 formed by casting of an aluminum alloy and having cylinder liner inserts 20 within which reciprocating pistons 34 are carried, it is possible to cast the aluminum alloy block 10 directly around the liner inserts 20. However, because of the absence of the formation of an alloy between the molten aluminum and the cylinder liner material, ferrous or aluminum, (due to surface conditions on the liner inserts and inadequate time at temperature), the resulting interface is merely a discontinuous mechanical connection which operates to impede heat transfer from the liner to the coolant on the aluminum side of the interface.

It has been found that a layer of a suitable lower-melting-temperature metallic material (one that will alloy both with the cylinder liner insert material and with the cast aluminum) when properly applied to the treated external cylindrical surface 26 of a cylinder liner insert, can result in the formation of a metallurgical bond between the liner insert 20, the bonding material and the cast aluminum (alloy) block 10. The resultant metallurgical bond avoids the distinct discontinuous interface that is characteristic of joints between dissimilar metals or difficult-to-join materials, and it provides a substantially continuous, uninterrupted heat transfer path. For such a metallurgical bond to occur it is necessary that alloying take place between the different metallic materials of the system.

Zinc, tin, and alloys thereof (for example nearly pure zinc, nearly pure tin, 95% zinc and 5% aluminum, 95% tin and 5% zinc, or 95% tin and 5% antimony) all have been found to be suitable metallic bonding materials that are capable of alloying with and forming metallurgical bonds with both ferrous-based inserts and with aluminum based inserts, or with aluminum alloys such as, for example, alloys 319, 333, 356, 380, or 390 (Aluminum Association designations) which are suitable to be used for casting internal combustion engine blocks. Hereinafter, although reference will be made only to zinc as the metallic bonding material, it should be appreciated that the metals and alloys mentioned above, as well as other comparable metals and alloys, can be substituted for the zinc, the discussion based upon zinc being for convenience of reference only.

Further, although cadmium could also be suitable for the metallic bonding material, the toxicity of cadmium compounds, and the negative consequences to the environment of residuals of such compounds, renders cadmium's employment for the purpose undesirable.

The successful application of metallic bonding materials to the surfaces of inserts requires that the surfaces to be coated be receptive to the bonding material. For example, a cast iron cylinder liner insert having a tubular structure as illustrated in FIGS. 1 and 2 should have its outer surface either grit blasted or machined to remove casting sand, oxides, and impurities prior to being coated. Additional surface pretreatments can also be performed on the thus cleaned outer cylindrical surface to make it even more receptive to the metallic bonding material. Such additional pretreatments can include further sand or grit blasting of the surface, electrolytic deoxidation in a salt bath (such as the Kolene Process, as performed by the Kolene Corporation, of Detroit, Mich.) for removal of graphite from the surface of cast iron liner inserts, and the application to the surface of cast iron liner inserts of a liquid flux (such as Zaclon K, available from E.I. dupont de Nemours & Co., Inc., of Wilmington, Del.).

After pretreatment of the outer cylindrical surface of the liner insert is complete, a coating of the metallic bonding material is applied. A preferred bonding material is substantially pure zinc, which has a melting temperature lower than that of both cast iron and aluminum, but higher than the expected service temperature of engine blocks. Zinc is capable of forming a metallurgical bond with either iron or aluminum.

The zinc bonding material can be applied to a pretreated, preheated ferrous liner insert by dipping the insert into molten zinc for a period of time sufficient to completely wet the outer surface of the liner insert with the zinc (for example about one minute or more). The temperature to which the liner is preferably preheated is about 250° F., and the molten zinc is maintained at a temperature of about 900° F. Preferably, the as-coated thickness of the zinc coating is at least 0.004 inches.

The zinc bonding material can be applied to a preheated aluminum liner insert by dipping the insert into molten zinc or zinc-aluminum alloy contained in an ultrasonically energized coating pot for a period of time sufficient to completely wet the outer surface of the liner insert with the zinc or zinc alloy (for example, about 5 seconds or more). The temperature to which the liner is preferably preheated is about 750° F., and the molten zinc or zinc alloy is maintained in the ultrasonic coating pot at a temperature of about 790° F. Preferably, the as-coated thickness of the zinc or zinc alloy coating is about 0.001 inches.

After removal of the coated liner from the molten zinc, the liner is permitted to cool to allow the zinc or zinc alloy to solidify. Cooling can be affected either by allowing the coated liner to cool in ambient air (still or moving); or to allow the liner to air cool for a period of about one minute followed by quenching in ambient temperature water. Thereafter, the coated liner inserts can be stored for later use.

When it is desired to cast an aluminum alloy engine block having liner inserts, the necessary number of liner inserts (coated as described above) must be inserted into and suitably held in position within the engine block mold. Molten aluminum alloy is then poured into the mold and around the liner inserts to fill the mold. The surface coating of zinc or zinc alloy, having a lower melting temperature than that of the aluminum alloy poured around it, is melted by the higher temperature of the molten aluminum, and an alloy is formed between the zinc and the aluminum, resulting in a metallurgical bond between the liner coating and the aluminum block material upon solidification of the engine block.

Preferably, coated ferrous liner inserts first have the zinc coating machined to remove surface oxides and then are preheated (for example, to a temperature of about 250° F.) before being placed into the mold and having the molten aluminum poured into the mold.

Preheating of liner inserts is intended to avoid excessive cooling of the molten aluminum immediately adjacent to the liner which can adversely affect the formation of the metallurgical bond and can lead to misruns in the cast engine block near or adjacent to the liners, which renders the block unusable.

Additionally, when a permanent mold is employed, the mold itself is preferably preheated, for example, to a temperature of about 450° F. or more, and any cores used to locate and support the cylinder liner inserts are also preferably preheated, for example, to a temperature of about 525° F. or more. The pouring temperature of the molten aluminum alloy, which, for example, can be made up of a 50:50 mixture of scrap 319 alloy and 319 alloy ingot, is preferably about 1375° F.

The following examples will illustrate the practice of the present invention by disclosing several liner treating processes for providing the desired external metallic coating on liner inserts which have the desired metallurgical bond between the liner inserts and the coating.

EXAMPLE I

A cast iron cylinder liner insert was provided having an inner diameter of 3.220 inches, an initial as-cast outer cylindrical surface, and an axial length of 5.125 inches. The outer cylindrical surface was machined on a lathe to a final diameter of 3.630 inches to remove casting sand, oxides, and impurities. The outer cylindrical surface was then grit blasted with #25 size steel grit until a uniform, clean, whitish metallic surface was observed. The so-treated liner insert was then heated in an oven for 20 minutes until it reached a temperature of about 250° F. After heating, the liner insert was installed on a dipping fixture to hold the liner while it was dipped in a zinc melt. The dipping fixture was preheated to about 400° F. immediately before the liner was installed on the fixture.

A initial melt of substantially pure zinc was provided in a first crucible and was maintained at a temperature of 1000° F. ±10° F. A second zinc melt of substantially pure zinc was provided in a second crucible and was maintained at a temperature of 840° F. ±10° F. The liner and dipping fixture were then immersed in the first zinc melt for a period of 10 minutes, during which time the pretreated outer surface of the ferrous liner insert was completely exposed to the molten zinc, allowing the iron insert and the molten zinc to react to form intermetallic Fe-Zn phases.

After immersion in the first zinc melt for the prescribed time, the liner insert and dipping fixture were removed from the first zinc melt and immediately immersed in the second zinc melt for a period of 10–30 seconds and were then withdrawn and allowed to air cool for one minute (to allow any trapped gas to escape from the molten zinc coating) whereupon the liner insert and fixture were quenched by immersion in an ambient temperature water bath to cause rapid solidification of the coating thus stopping the iron-zinc reaction.

Figure 3:
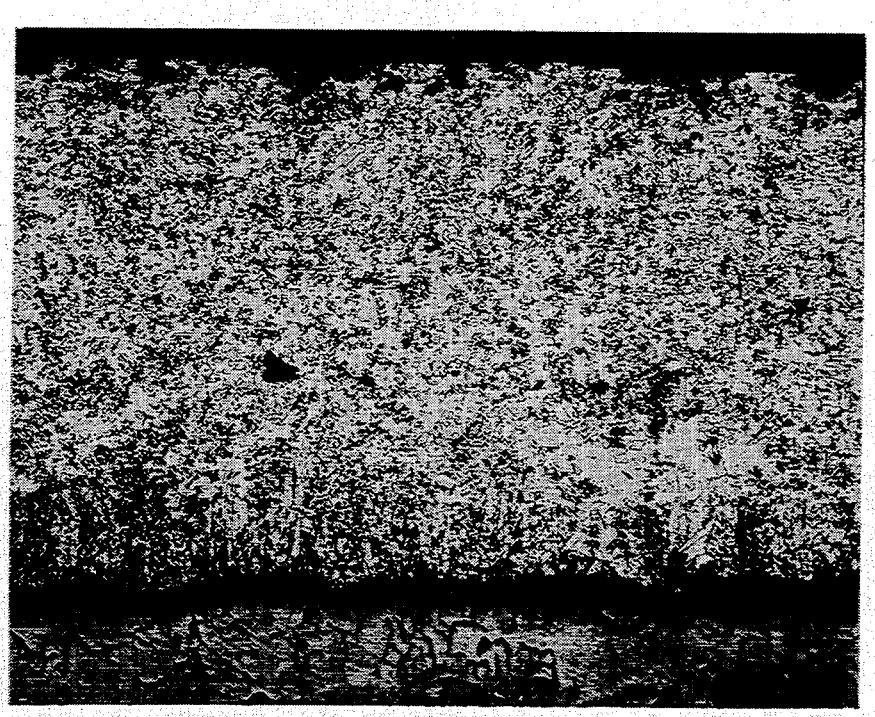
FIGS. 3 through 7 are photomicrographs of enlarged sections at the interface between a ferrous cylinder liner insert and a metallic bonding material surface coating to illustrate the microstructure of the metallic coating and the integrity of the bond at the interface for each of five different ferrous material surface coating application techniques. For each of FIGS. 3 through 7, the uppermost layer shown is the metallic bonding material and the layer at the bottom of each figure is the ferrous insert material.

A sample was cut from the so-coated cast iron liner insert and was metallographically prepared and etched with a 1% nital solution for microscopic examination. FIG. 3 is a photomicrograph taken at 200 magnification of an area of an etched cross-section sample taken at the iron-zinc interface. The structure of the coating revealed a uniform distribution of diffuse iron/zinc delta (92Zn:8Fe) intermetallic phase (small rectangular shaped particles) dispersed in a substantially pure zinc matrix. The bond is continuous and the diffusion of the iron into the zinc is evidenced by the presence of columnar crystals of dense iron/zinc delta (88Zn:12Fe) intermetallic phase at the iron/zinc interface. The as-coated thickness of the zinc bonding material was about 0.016 inches.

EXAMPLE II

A cast iron cylinder liner insert was provided having an inner diameter of 3.220 inches, an initial as-cast outer surface, and an axial length of 5.215 inches. The outer cylindrical surface was machined on a lathe to a final outer diameter of 3.630 inches to remove casting sand, oxides, and impurities from the surface. The liner insert was then sent to the Kolene Corporation, in Detroit, Mich., for treatment by subjecting the outer cylindrical surface to the Kolene process for removal of free graphite and oxides.

The so-treated liner insert was then preheated in an oven for about 20 minutes until the liner reached a temperature of about 250° F. After preheating, the liner insert was installed on a dipping fixture to hold the liner while it was dipped into a zinc melt. The dipping fixture was preheated to about 400° F. immediately before the liner insert was installed on the fixture.

A melt of substantially pure zinc was provided in a crucible and was maintained at a temperature of 1000° F. ±10° F. The liner insert and dipping fixture were then immersed in the zinc melt for a period of 5 minutes, during which the pretreated outer surface of the liner was completely exposed to the molten zinc, allowing the iron insert and molten zinc to react to form intermetallic Fe-Zn phases.

Upon removal from the zinc melt, the liner insert was removed from the dipping fixture and permitted to cool in still air until it reached ambient temperature.

Figure 4:
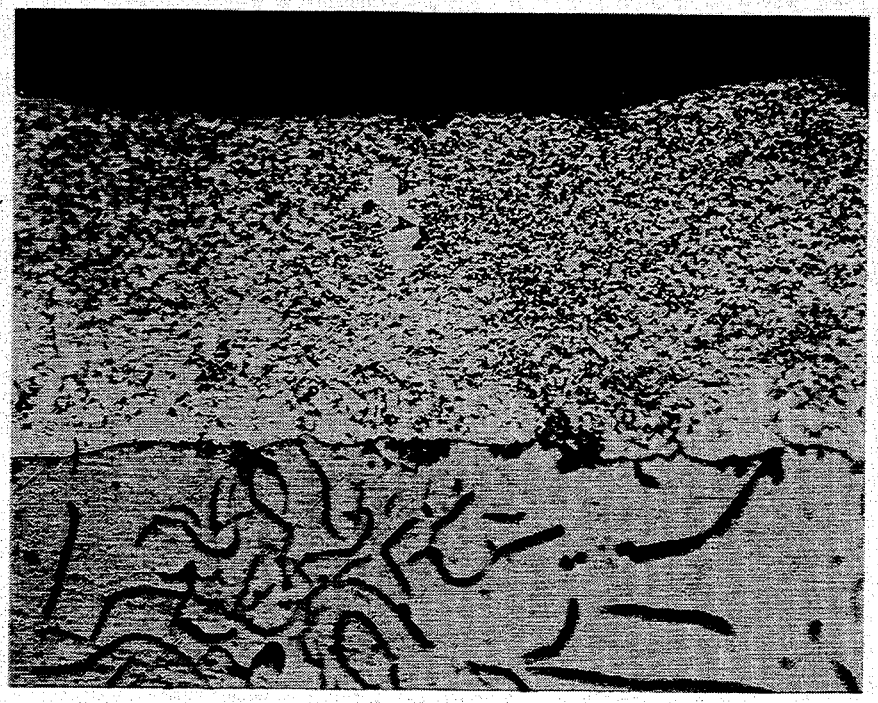

A sample was cut from the so-coated cast iron cylinder liner insert and was metallographically prepared and etched with a 1% nital solution for microscopic examination. FIG. 4 is a photomicrograph taken at 400 magnification of an area from an etched cross-sectional sample taken at the iron-zinc interface. The coating is characterized by an absence of graphite flakes protruding from the iron surface into the zinc coating, due to the prior removal of graphite from the insert surface by the Kolene surface treatment process. Additionally, no free graphite flakes can be seen in the zinc coating. A layer of the dense delta intermetallic phase (88Zn:12Fe) can be seen at the iron/aluminum interface, indicating the appropriate reaction of the iron with molten zinc to form a metallurgical bond. The thickness of the as-coated zinc was approximately 0.011 inches.

EXAMPLE III

A cast iron cylinder liner insert was provided having an inner diameter of 3.220 inches, an initial as-cast outer cylindrical surface, and an axial length of 5.125 inches. The outer as-cast surface was machined on a lathe to a final outer diameter of 3.630 inches to remove casting sand, oxides, and impurities. The outer cylindrical surface of the machined liner insert was exposed in air at a temperature of 1200° F.,+10° F. for about 1 hour to oxidize the outer surface. The thus oxidized insert was then grit blasted (to remove the oxide layer) until a uniform, clean, whitish metallic surface was observed.

The so-treated liner insert was then preheated in an oven for about 20 minutes until the liner reached a temperature of about 250° F. After preheating, the liner insert was installed on a dipping fixture to hold the liner while it was dipped into a zinc melt. The dipping fixture was preheated to about 400° F. immediately before the liner was installed on the fixture.

A melt of substantially pure zinc was provided in a crucible and was maintained at a temperature of 1000° F. ±10° F. The liner insert and dipping fixture were then immersed in the zinc melt for a period of 5 minutes, during which the pretreated outer surface of the liner was completely exposed to the molten zinc, allowing the iron insert and molten zinc to react to form intermetallic Fe-Zn phases.

Upon removal from the zinc melt, the liner insert was removed from the dipping fixture and permitted to cool in still air until it reached ambient temperature.

Figure 5:
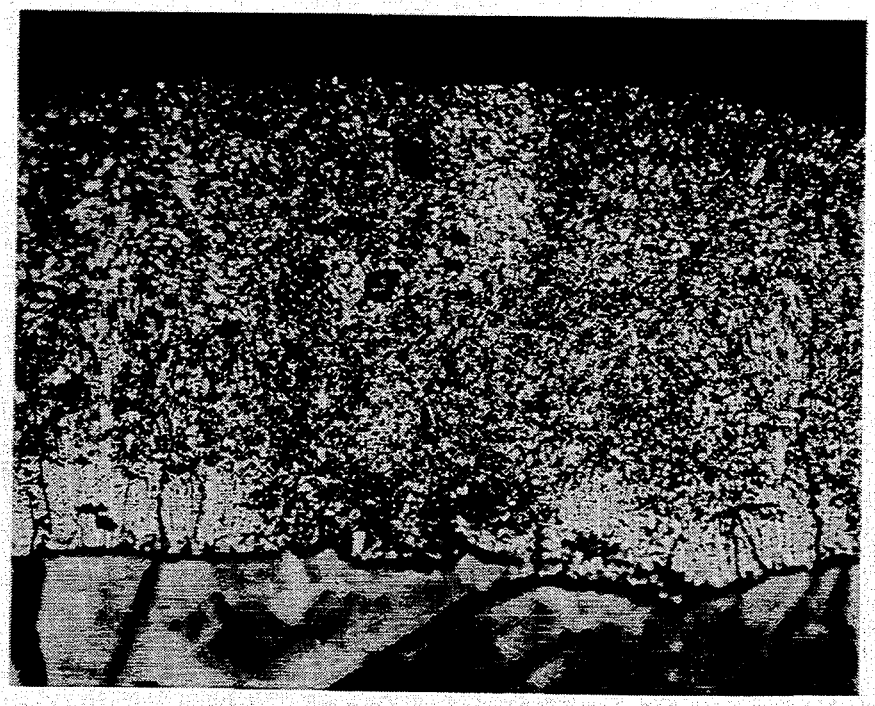

A sample was cut from the so-coated cast iron cylinder liner insert and was metallographically prepared and etched with a 1% nital solution for microscopic examination. FIG. 5 is a photomicrograph taken at 400 magnification of an area of an etched cross-sectional sample taken at the iron-zinc interface. The structure illustrated shows good reaction and an excellent bond at the iron/zinc interface, as evidenced by the presence of columnar crystals of dense delta intermetallic phase (88Zn:12Fe). The coating structure contained diffuse delta phases (92Zn:8Fe) in a zinc matrix. The as-coated zinc thickness was approximately 0.008 inches.

EXAMPLE IV

A cast iron cylinder liner insert was provided having an inner diameter of 3.220 inches, an initial as-cast outer cylindrical surface, and an axial length of 5.125 inches. The outer cylindrical surface was machined on a lathe to a final outer diameter of 3.630 inches to remove casting sand, oxides, and impurities. The outer surface of the liner insert was then exposed to a flux solution prepared by mixing 0.44 pounds of Zaclon K (available from E.I. dupont de Nemours & Co., Inc., of Wilmington, Del.) in one gallon of water and heating the mixture to a temperature of 170° F. ±10° F. The liner insert was dipped in the flux solution for 3 minutes, then removed and allowed to air dry.

The so-treated liner insert was then heated in an oven for about 20 minutes until the insert reached a temperature of about 250° F. After preheating, the liner insert was installed on a dipping fixture to hold the liner while it was dipped into a zinc melt. The dipping fixture was preheated to about 400° F. immediately before the liner was installed on the fixture.

A melt of substantially pure zinc was provided in a crucible and was maintained at a temperature of 940° F. ±10° F. The liner insert and dipping fixture were then immersed in the zinc melt for a period of 1 minute, during which the pretreated outer surface of the liner insert was completely exposed to the molten zinc, allowing the iron insert and molten zinc to react to form intermetallic Fe-Zn phases.

Upon removal from the zinc melt, the liner insert was removed from the dipping fixture and permitted to cool in still air until it reached ambient temperature.

Figure 6:
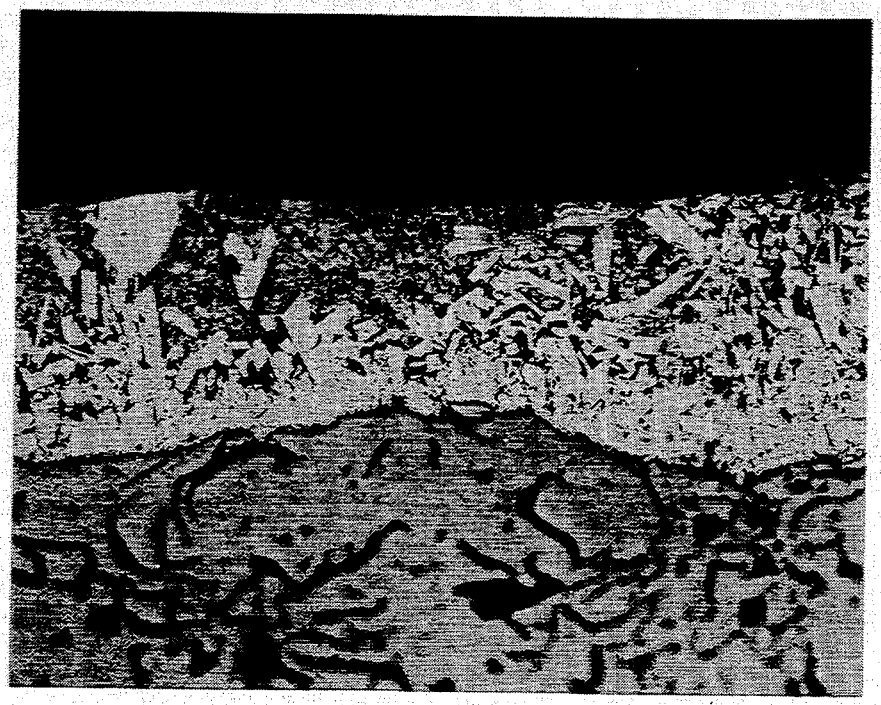

A sample was cut from the so-coated cast iron cylinder liner and was metallographically prepared and etched with a 1% nital solution for microscopic examination. FIG. 6 is a photomicrograph taken at 400 magnification of an area of an etched cross-sectional sample taken at the iron-zinc interface. The structure illustrated shows excellent reaction of the iron with the zinc, as evidenced by the growth of zeta intermetallic (94Zn:6Fe) crystals at the iron/zinc interface, which results in metallurgical bonding of the iron and the zinc coating. The coating structure consisted of pure zinc with no intermetallic phases because the molten zinc dipping temperature was below the delta intermetallic phase formation temperature. The as-coated zinc thickness averaged approximately 0.0122 inches.

EXAMPLE V

A cast iron cylinder liner insert was provided having an inner diameter of 3.220 inches, an initial as-cast outer cylindrical surface, and an axial length of 5.215 inches. The outer as-cast cylindrical surface was machined on a lathe to a final outer diameter of 3.630 inches to remove casting sand, oxides, and impurities from the surface.

The so-treated liner insert was then preheated in an oven for about 20 minutes until it reached a temperature of about 250° F. After preheating, the liner insert was installed on a dipping fixture to hold the liner while it was dipped into a zinc melt. The dipping fixture was preheated to about 400° F. immediately before the liner insert was installed on the fixture.

A melt of substantially pure zinc was provided in a crucible and was maintained at a temperature of 1000° F. ±10° F. The liner and dipping fixture were then immersed in the zinc melt for a period of 5 minutes, during which the preheated outer surface of the liner was completely exposed to the molten zinc, allowing the iron insert and molten zinc to react to form intermetallic Fe-Zn phases.

Upon removal from the zinc melt, the liner was removed from the dipping fixture and permitted to cool in still air until it reached ambient temperature.

Figure 7:
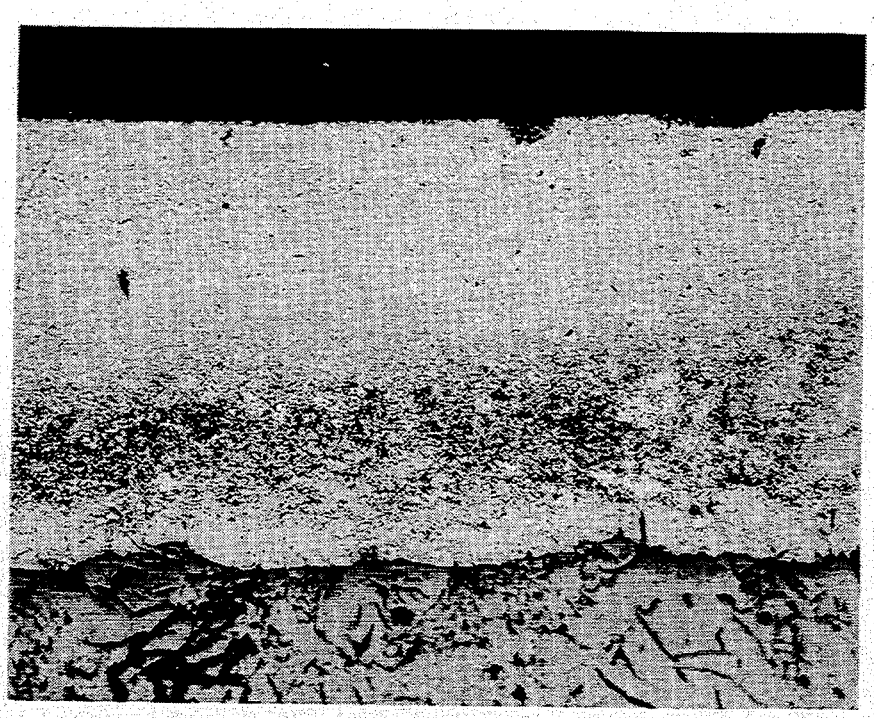

A sample was cut from the so-coated cast iron cylinder liner insert and was metallographically prepared and etched with 1% nital solution for microscopic examination. FIG. 7 is a photomicrograph taken at 200 magnification of an area of an etched cross-sectional sample taken at the iron-zinc interface. The structure includes a layer of the dense delta intermetallic phase (88Zn:12Fe) that formed at the iron surface, which indicates excellent iron/zinc reaction during the formation of the coating. The zinc coating was very uniform and had an as-coated thickness of approximately 0.0103 inches.

EXAMPLE VI

A390 aluminum alloy extrusion was machined to provide a cylinder liner insert having an inner diameter of 3.265 inches, an axial length of 5.30 inches, and an outer diameter of 3.665 inches.

After machining, the outer cylindrical surface of the liner insert was uniformly coated with an alloy of 95% zinc and 5% aluminum. The coating was applied by placing a 390 alloy cylinder liner insert that had been preheated to about 750° F. in an ultrasonic coating pot that contained the molten zinc-aluminum alloy coating material which was at a temperature of about 790° F., and by rotating the liner for about five seconds while applying ultrasonic energy. The resulting zinc-aluminum coating had a thickness of about 0.001 inches.

Upon removal from the zinc-aluminum alloy melt, the liner was permitted to cool in still air until it reached ambient temperature.

Figure 8:
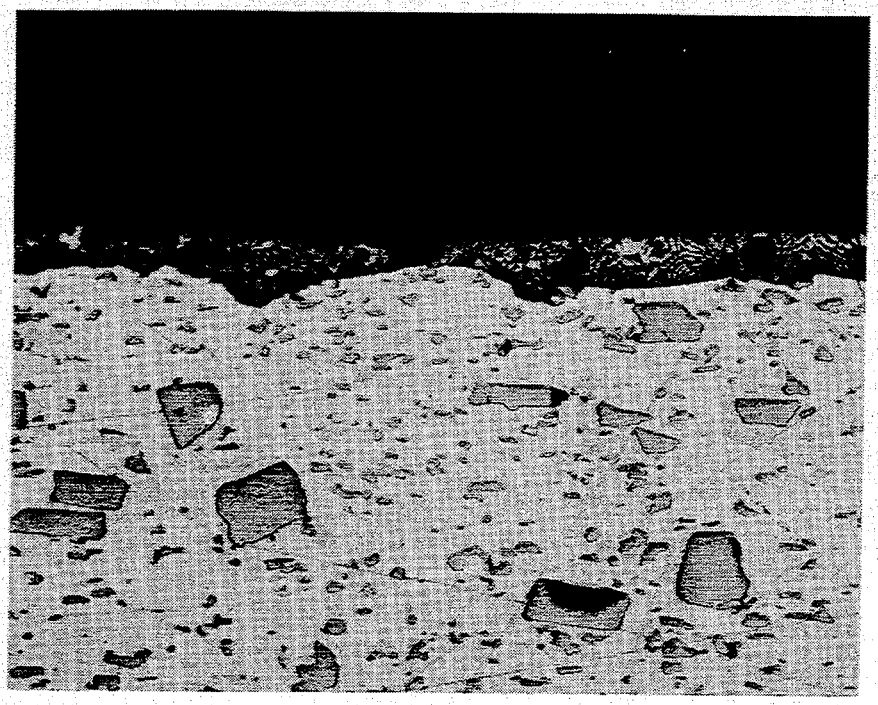
FIG. 8 is a photomicrograph of an enlarged section between an aluminum alloy cylinder liner insert and a metallic bonding material surface coating to illustrate the microstructure and the integrity of the bond at the interface. In that Figure, the uppermost layer shown is the metallic bonding material and the layer at the bottom is the aluminum insert material.

A sample was cut from the so-coated aluminum cylinder liner and was metallographically prepared for microscopic examination. FIG. 8 is a photomicrograph taken at 200 magnification of an area of a cross sectional sample taken at the aluminum-zinc interface. The structure shows the aluminum alloy with a zinc-rich surface, indicating excellent aluminum/zinc reaction during formation of the coating.

Cylinder liner inserts that have been surface treated in accordance with the processes described in the foregoing Examples I through VI can be stored for future use when casting aluminum engine blocks and need not be used immediately.

When it is desired, after a period of storage, that the liner inserts be incorporated into an aluminum alloy engine block in a casting operation, the zinc-coated surface of the inserts may require further treatment in order to achieve acceptable metallurgical bonding between the liner inserts and the aluminum casting alloy. Oxide that may form on the zinc-coated surface of the liner insert must be removed. A preferred method for affecting such oxide removal is by turning the outer zinc coated cylindrical surface of the liner on a lathe.

After removal of the oxide, casting can be delayed, for example, for days, without adversely affecting the metallurgical bond between the liner inserts and the aluminum casting alloy.

Casting of the aluminum engine block can be performed by using either a permanent mold or a sand mold. In either case, the coated liner inserts should be preheated to about 250° F., and should be held at that temperature for no longer than one hour, preferably only from about 15 to about 30 minutes.

The casting conditions for assuring a substantially continuous metallurgical bond between cylinder liner inserts and a cast aluminum alloy block cannot be precisely specified, because those conditions are directly dependent upon other variables such as the casting alloy selected, the specific casting process (for example, sand or permanent mold), the size, average wall thickness, and specific configuration of the engine block to be cast, the number and placement of cores within the mold, and the position of the pouring sprue, runners and ingates.

In the tests conducted as reflected in the Examples VII through IX that follow, the aluminum alloy material was cast around the outer cylindrical surfaces of treated liner inserts to provide an annular outer aluminum alloy layer on the outer cylindrical surfaces of the liner inserts. The casting conditions that were found to produce good results when casting an aluminum alloy outer layer on treated cast iron cylinder liner inserts in a specific permanent mold (simulating a single cylinder section of a multi-cylinder engine block) were as follows:

| | |
|---|---|
| Coated liner preheat temperature | 250° F., ±15° F. |
| Mold half temperature | 450° F., ±25° F. |
| Liner positioning core temperature | 525° F., ±25° F. |
| Molten aluminum alloy temperature | 1375° F., ±25° F. |
| Pouring rate | 50 lb./min., ±4 lb./min |

When the casting operation was performed using a specific sand mold (simulating a single cylinder section of a multiple-cylinder engine block), the casting conditions were similar to those specified above for permanent mold casting except that the casting temperature of the aluminum alloy was increased to about 1425° F.

The following two examples illustrate casting conditions that were found to be suitable for the formation of a good metallurgical bond between the outer cylindrical surface of zinc-coated, cast iron cylinder liner inserts and a cast outer layer of aluminum alloy. Example VII utilizes a permanent mold, and Example VIII utilizes a sand mold.

EXAMPLE VII

A zinc coated, cast iron cylinder liner insert was prepared in accordance with the method of Example V. The outer cylindrical surface of the coated liner insert was then machined on a lathe to provide a final zinc coating thickness of about 0.004 inches. The machined liner was then preheated in an oven until the liner attained a temperature of about 250° F.

An iron permanent mold was provided and was evenly preheated with a gas burner until the mold halves attained a temperature of about 525° F. and the liner-locating core attained a temperature of about 600° F., as measured using a surface-contact pyrometer. The mold was configured to provide an outer, cast cylindrical layer of aluminum alloy that completely surrounded the outer cylindrical surface of the coated liner insert, the aluminum alloy layer having a thickness of about 0.600 inches.

A mixture of 50% by weight of 319 aluminum alloy scrap and 50% 319.1 aluminum alloy ingot was melted and brought to a temperature of about 1275° F. The mixture was fluxed for a minimum of 20 minutes using $SF_6$ gas with a spinning-nozzle degasser. After fluxing, a Straube-Pfeiffer hydrogen gas test sample was solidified under 27 inches of mercury gage pressure, the results of which were interpreted to indicate that the 319 alloy melt contained less than 20 ppm of hydrogen. The chemistry of the molten alloy was adjusted by adding 0.3% by weight of pure magnesium to that portion of the melt that was made up of 319.1 alloy ingot resulting in an alloy meeting the Aluminum Association specification for B319.

At the time of actual casting, the mold halves were at a measured temperature of 469° F., the mold core was at a temperature of 517° F. the liner was at a temperature of 253° F. and the molten B319 casting alloy was at a temperature of 1375° F. The pouring sprue was choked to limit the molten aluminum alloy flow rate into the mold to no greater than 100 lb./min.

The molten B319 alloy was poured into the mold at a substantially constant rate of about 50 lb./min. until the mold was filled and the liner insert was surrounded with the cast aluminum alloy. After allowing sufficient time for solidification of the aluminum alloy to occur (about 2 ½ minutes), the center core was withdrawn and the mold was opened to permit withdrawal of the casting.

Figure 10:
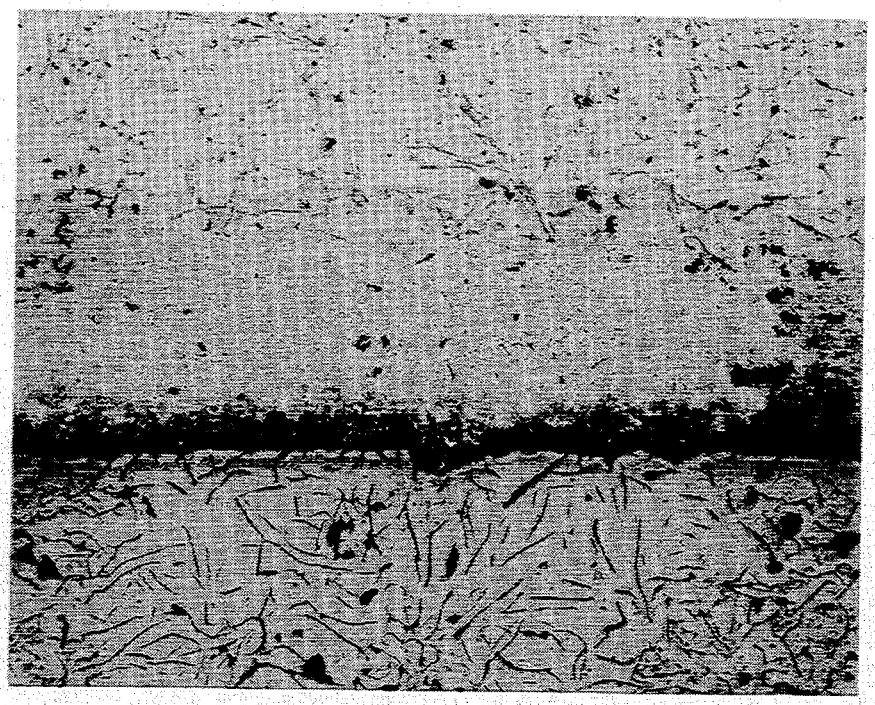
FIG. 10 is a photomicrograph of an enlarged section at the interface of a coated ferrous cylinder liner insert and an aluminum engine block section that has been cast about the liner, illustrating the microstructure and integrity of the metallurgical bond created at that interface.

The resulting casting was sectioned perpendicular to the cylindrical axis to provide three 1 inch high transverse ring samples. The two remaining intermediate ring sections were metallographically prepared for microscopic examination. The metallographic sections revealed that the liner and surrounding cast aluminum were metallurgically bonded and there was substantially no porosity at the bond interface. FIG. 10 illustrates at 100 magnification the microstructure at the iron:zinc:aluminum interface.

A hydraulic press was used to apply a shear load to the metallurgical bond of each of the three 1 inch transverse ring sections. These ring sections demonstrated a metallurgical bond between the liner and the zinc coating, and between the zinc coating and the surrounding aluminum alloy layer by resisting without movement a shear force of 64,000 lbsf. applied to the liner and surrounding cast aluminum. In that regard, similar shear forces of about 5,000 lbsf. will often cause movement of nonbonded pressed-in-place cast iron cylinder liner inserts. Also, when a similar shear force of 64,000 lbsf. is applied to an all-aluminum ring (B319 alloy without an iron liner insert), the yield strength of the ring is exceeded and the aluminum deforms.

Figure 11:
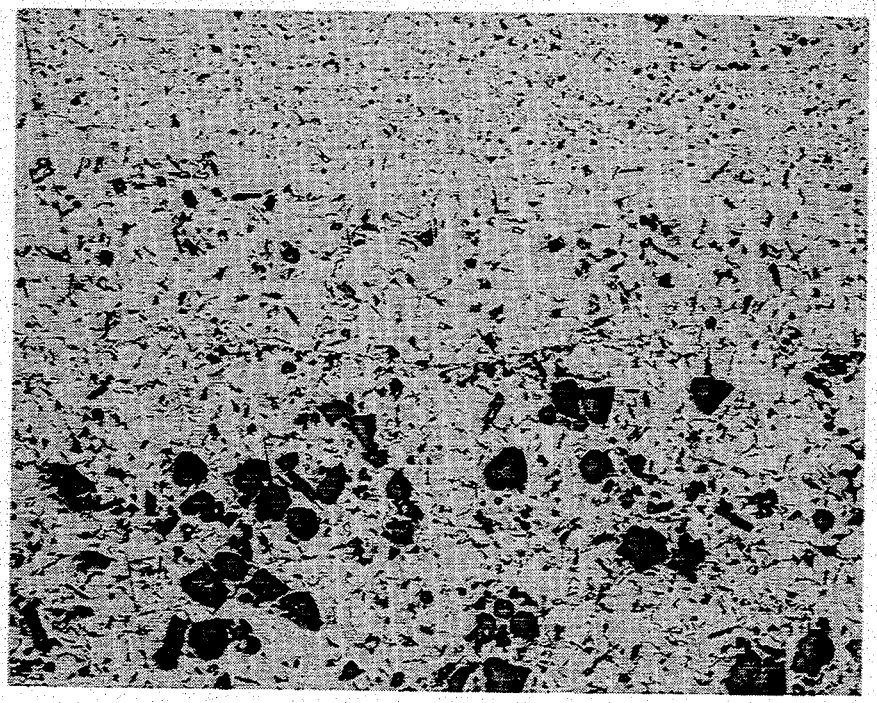
FIG. 11 is a photomicrograph of an enlarged section at the interface of a coated aluminum cylinder liner insert and an aluminum engine block section that has been cast about the liner, illustrating the microstructure and integrity of the metallurgical bond created at that interface.

Referring once again to the drawings, and particularly to FIGS. 9, 9*a*, 10 and 11 thereof, there is shown in FIG. 9*a* a cross sectional view of an engine block 10, taken along the line 2—2 of FIG. 9, showing cylinder liner insert 20 having been cast in place and metallurgically bonded to engine block 10 at the interface 28 between insert 20 and the cast aluminum of block 10. FIG. 10 shows microstructural details of interface 28 when liner 10 is of a ferrous material, as described in Example VII. FIG. 11 similarly shows microstructural details of interface 28 when liner 10 is of an aluminum material, as described in the following Example IX. Both FIGS. 10 and 11 illustrate the continuous nature of the metallurgical bond created at interface 28 by the practices given in Examples VII and IX.

EXAMPLE VIII

A sand casting mold was prepared to provide a cast product somewhat similar to the cast product of Example VII. A zinc coated cast iron cylinder liner insert was prepared in accordance with the method of Example V. The outer cylindrical surface of the coated liner insert was then machined on a lathe to provide a final zinc coating thickness of about 0.009 inches, and the same aluminum casting alloy and alloy treatment were employed as is described in Example VII.

The liner was preheated to a measured temperature of 222° F., and the pouring temperature of the aluminum casting alloy was 1412° F. The pouring rate was 150 lb./min.; and after pouring was completed, the casting was allowed to solidify and cool for at least three minutes before the cast article was withdrawn from the mold. The resulting casting had an external, cylindrical aluminum alloy layer thickness of about 0.300 inches.

The casting was sectioned perpendicular to the cylindrical axis to provide three 1 inch high transverse ring samples. The two remaining intermediate ring sections were metallographically prepared for microscopic examination. The metallographic sections revealed that there was substantially no porosity at the metallurgical bond interface.

A hydraulic press was used to apply a shear load to the metallurgical bond of each of the three 1 inch ring sections. These ring sections exhibited the presence of a metallurgical bond between the liner and the zinc coating, and between the zinc coating and the surrounding aluminum alloy layer by resisting without movement a shear force of 62,000 lbsf. applied to the liner and surrounding cast aluminum. When the same 62,000 lbsf. is applied to an all-aluminum ring, the yield strength of the ring is exceeded and the aluminum deforms.

The processes described above provided a strong, continuous metallurgical bond between a ferrous-based cylinder liner insert and a simulated cast aluminum alloy engine block to permit the achievement of lighter weight engines having substantially the cylinder wear characteristics of engines having cast iron blocks.

The above-described methods can also be employed to provide a cast article in which an aluminum alloy cylinder liner insert (for example, made from 390 alloy)

has another aluminum alloy cast around it to provide an all aluminum engine block. The following example discloses one set of conditions that provided a reasonably good bond between a 390 aluminum alloy cylinder liner insert and a surrounding sleeve of cast aluminum alloy B319.

EXAMPLE IX

A 390 aluminum alloy cylinder liner insert was formed according to the method described in Example VI. An iron permanent mold was provided and was evenly preheated with a gas burner until the mold halves attained a temperature of about 525° F. and the liner-locating core attained a temperature of about 600° F., as measured using a surface-contact pyrometer. The mold was configured to provide an outer, cast cylindrical layer of aluminum alloy on the outer cylindrical surface of the liner, the aluminum alloy layer having a thickness of about 0.600 inches and completely surrounding the outer cylindrical surface of the liner.

The aluminum alloy casting material was prepared in the same manner and had substantially the same composition as the casting material described in Example VII above.

At the time of casting, the mold halves were at a measured temperature of 263° F., the mold core was at a temperature of 246° F., the liner was at a temperature of 157° F., and the molten aluminum casting alloy was at a temperature of 1223° F. The pouring sprue was choked to limit the molten aluminum alloy flow rate into the mold to less than about 100 lb./min.

The molten aluminum alloy was poured into the mold at a substantially constant rate of about 50 lb./min. until the mold was filled and the liner insert was surrounded with the cast aluminum alloy. After allowing sufficient time for solidification of the molten aluminum alloy to occur (about 2 ½ minutes), the center core was withdrawn and the mold was opened to permit withdrawal of the completed casting.

The casting was then sectioned to provide three 1 inch long transverse ring sections, cut perpendicular to the cylindrical axis. The two remaining intermediate ring sections were metallographically prepared for microscopic examination. The metallographic sections exhibited good metallurgical bonding between the 390 alloy cylinder liner insert and the surrounding layer of aluminum alloy casting material as is illustrated in FIG. 11. Ultrasonic inspection indicated that bonding ranged from about 56% in a section taken at the top of the cast cylinder to about 76% in a section taken at the bottom. Visual inspection of the machined surfaces of the three transverse ring sections revealed that there was substantially no porosity at the metallurgical bond interface.

An attempt to push the liner insert axially from the three 1 inch ring sections required shear forces ranging from about 12,000 lbsf. to about 18,000 lbsf. to affect push-out of the liner, which demonstrates a good bond between the liner and the surrounding aluminum alloy casting material.

In general, control of the required casting conditions when the liner insert material is an aluminum alloy is more critical than is applicable to cast-in-place iron liner inserts, so as to avoid excessive heating of the aluminum alloy liner insert and to prevent melting of the casting alloy into and through the wall of the aluminum liner insert.

The results of comparative metallurgical bond integrity tests performed during numerous casting trials using cast iron cylinder liner inserts, prepared in accordance with the methods described in Examples I through V above, are shown in Tables I and II below, for permanent mold and sand mold cast-in-place liner inserts, respectively. Also shown in Table I are comparative test results for uncoated cylinder liner inserts, as well as cylinder liner inserts coated by the so-called "ALFIN" process.

In each of Tables I and II the numerical porosity rating is a qualitative measure of the amount of porosity determined from visual inspection of the machined surfaces of the three 1 inch thick transverse rings (on a scale of zero to 36, with 36 representing the least porosity). This rating is indicative of the efficiency with which the metallurgically bonded iron/zinc/aluminum joint can transfer heat and of the structural integrity of the joint.

The pushout strength values shown in Tables I and II are the averages over numerous trials representing each of the coating Examples I through V. Pushout values are the axial forces (in thousands of pounds) needed to initiate axial displacement of the cylinder liner insert in the 1 inch thick transverse rings relative to the surrounding cast aluminum alloy using a hydraulic press. The pushout forces could range from zero to 64,000 lbsf., with the maximum force attempted being 64,000 lbsf. While bonds often did not break at the maximum force applied, this force was sufficient to plastically deform the aluminum cast material surrounding the cast iron liner insert.

The overall rating, as given in Tables I and II, is the arithmetic sum of the average porosity rating and the average pushout strength (maximum rating is 36 + 64 = 100).

TABLE I

PERMANENT MOLD
CAST-IN-PLACE ZINC
COATED CAST IRON LINER COMPARISON

| COATING TYPE | AVERAGE POROSITY RATING | AVERAGE PUSHOUT STRENGTH (× 1,000 LB.) | OVER-ALL RATING |
|---|---|---|---|
| "ALFIN" PROCESS | 35 | 64 | 99 |
| UNCOATED CAST IRON | 36 | 5 | 41 |
| EXAMPLE I | 22 | 52 | 74 |
| EXAMPLE II | 29 | 51 | 80 |
| EXAMPLE III | 30 | 39 | 69 |
| EXAMPLE IV | 24 | 61 | 84 |
| EXAMPLE V | 28 | 45 | 73 |

TABLE II

SAND MOLD
CAST-IN-PLACE ZINC
COATED CAST IRON LINER COMPARISON

| COATING TYPE | AVERAGE POROSITY RATING | AVERAGE PUSHOUT STRENGTH (× 1,000 LB.) | OVER-ALL RATING |
|---|---|---|---|
| EXAMPLE I | 28 | 48 | 76 |
| EXAMPLE II | — | — | — |
| EXAMPLE III | 27 | 40 | 67 |
| EXAMPLE IV | 30 | 45 | 75 |
| EXAMPLE V | 30 | 41 | 71 |

As is apparent from the data presented in Tables I and II, the methods in accordance with the present invention provide a liner insert-aluminum alloy interface that is metallurgically bonded, that is free from excessive porosity, and that therefore promotes good heat transfer across the interface. These methods also result in improved structural integrity of the assembly of joined elements. In that regard, the push-out strengths, for the test specimens made by following the several coating methods herein described and shown in the tables, demonstrate the strong structural bond that exists at the interface, whether the casting operation is performed in a permanent mold or in a sand mold.

Although described herein in terms of a tubular cylinder liner insert for incorporation into a cast aluminum alloy engine block, the present invention is not restricted to cast-in-place cylinder liner inserts in aluminum engine blocks, but can also be employed to cast and secure valve guides and valve seats into aluminum engine cylinder heads, or to cast and secure other such inserts into cast aluminum articles for purposes of improving the performance of the aluminum articles in local areas.

Although particular embodiments of the present invention have been illustrated and described, it will be apparent to those skilled in the art that changes and modifications can be made without departing from the spirit of the present invention. It is therefore intended to encompass within the appended claims all such changes and modifications that fall within the scope of the present invention.

What is claimed is:

1. A process for producing a product having a ferrous article metallurgically bonded to an aluminum casting wherein molten aluminum alloy is poured around the coated ferrous article, said process comprising:

a. pretreating a surface to be coated of a ferrous article to remove impurities, oxides, and foreign material;

b. preheating the pretreated ferrous article to a temperature of about 250° F.;

c. providing a molten metallic bonding material of substantially pure zinc having a melting temperature lower than the melting temperature of the ferrous material and lower than the melting temperature of an aluminum alloy to be poured around the article, the ferrous material being soluble in the zinc bonding material and the zinc bonding material and the aluminum alloy being mutually soluble in each other and capable of forming intermetallic compounds with the ferrous material and metallurgically bonding to the outer surface of the ferrous article;

d. immersing the ferrous article in the molten zinc bonding material for a predetermined time to cause the molten zinc bonding material to contact and to wet the pretreated outer surface of the ferrous article to provide an outer surface coating of zinc bonding material on the ferrous article; and e. cooling the externally coated ferrous article to solidify the zinc bonding material.

2. A process in accordance with claim 1 wherein the pretreatment step includes machining the outer surface of the ferrous article with a single point tool to remove surface oxide.

3. A process in accordance with claim 1 wherein the molten zinc is provided at a temperature of about 1000° F.

4. A process in accordance with claim 3 wherein the immersion time of the ferrous article in the molten zinc is about five minutes.

5. A process in accordance with claim 4 wherein the ferrous article is air cooled after withdrawal from the molten zinc.

6. A process in accordance with claim 2 including the step of immersing the outer surface of the ferrous article in a liquid

7. A process in accordance with claim 6 wherein the zinc bonding material is maintained at a temperature of about 940° F. while the ferrous article is immersed in the bonding material.

8. A process in accordance with claim 7 wherein the ferrous article is immersed in the bonding material for about one minute.

9. A process in accordance with claim 8 wherein the ferrous article is air cooled after withdrawal from the molten bonding material.

10. A process in accordance with claim 2 including the step of oxidizing the ferrous article in air by heating the ferrous article to about 1200° F. for about 60 minutes after machining.

11. A process in accordance with claim 1 including the step of sand blasting the outer surface of the ferrous material after the oxidation step.

12. A process in accordance with claim 11 wherein the molten zinc bonding material is maintained at a temperature of about 1000° F. and the ferrous article is immersed in the bonding material for about 5 minutes.

13. A process in accordance with claim 11 wherein the ferrous article is air cooled after withdrawal from the molten bonding material.

14. A process in accordance with claim 2 including the step of exposing the outer surface of the ferrous article to a salt bath for removing oxides and surface graphite from the ferrous article.

15. A process in accordance with claim 11 wherein the molten zinc bonding material is maintained at a temperature of about 1000° F. and the ferrous article is immersed in the bonding material for about 5 minutes.

16. A process in accordance with claim 15 wherein the ferrous article is air cooled after withdrawal from the molten bonding material.

17. A process in accordance with claim 2 including the step of grit blasting the outer surface of the ferrous article after the machining step.

18. A process in accordance with claim 17 wherein the immersion step includes immersing the ferrous article for about 10 minutes in a first molten zinc bonding material which is maintained at a temperature of about 1000° F., withdrawing the ferrous article, and immersing the ferrous article for about 10 seconds in a second molten zinc bonding material which is is maintained at a temperature of about 840° F.

19. A process in accordance with claim 18 wherein the cooling step includes air cooling the coated ferrous article for about one minute and immediately thereafter quenching the coated article in ambient temperature water.

20. A process for producing a product having a ferrous article metallurgically bonded to an aluminum casting, the process comprising:

a. pretreating a surface of a ferrous article to remove impurities, oxides, and foreign material;

b. preheating the pretreated ferrous article to a temperature of about 250° F.;

c. providing a molten metallic bonding material of substantially pure zinc having a melting temperature lower than the melting temperature of the ferrous material and lower than the melting temperature of an aluminum alloy to be cast around the ferrous article, the ferrous material being soluble in the zinc bonding material and the zinc bonding material and the aluminum alloy being mutually soluble in each other and being capable of forming intermetallic compounds with the ferrous material and metallurgically bonding to the surface of the ferrous article;

d. immersing the ferrous article in the molten zinc bonding material for a predetermined time to cause the molten zinc bonding material to contact and to wet the pretreated outer surface of the ferrous article to provide an outer surface coating of zinc bonding material on the ferrous article;

e. cooling the externally coated ferrous article to solidify the zinc bonding material;

f. preheating the coated article and placing it in a mold; and g. pouring the molten aluminum alloy into the mold so that the aluminum alloy metallurgically bonds with the zinc bonding material thereby producing the article.

21. The process of claim 20, wherein the product is an engine block and the ferrous article is a cylinder liner metallurgically bonded to the aluminum casting forming the block.

22. The process of claim 20 further comprising machining the coated ferrous article prior to preheating.

23. A process for producing a product having a ferrous article metallurgically bonded to an aluminum casting the processs comprising:

a. pretreating a surface of a ferrous article to remove impurities, oxides, and foreign material;

b. preheating the pretreated ferrous article to a temperature of about 250° F.;

c. providing a molten metallic bonding material of substantially pure zinc having a melting temperature lower than the melting temperature of the ferrous article and lower than the melting temperature of an aluminum alloy to be cast around the article, the ferrous article being soluble in the zinc bonding material and the zinc bonding material and aluminum alloy being mutually soluble in each other and capable of forming intermetallic compounds with the ferrous article and metallurgically bonding to the outer surface of the ferrous article;

d. immersing the ferrous article in the molten zinc bonding material for a predetermined time to cause the molten zinc bonding material to contact and to wet the pretreated outer surface of the ferrous article to provide an outer surface coating of zinc bonding material on the ferrous article;

e. cooling the externally coated ferrous article to solidify the zinc bonding material; and f. machining the zinc bonding material on the cooled article.

* * * * *